US007039201B1

(12) United States Patent
Lee et al.

(10) Patent No.: US 7,039,201 B1
(45) Date of Patent: May 2, 2006

(54) AUDIO SIGNAL PHASE DETECTION SYSTEM AND METHOD

(75) Inventors: Barry Thomas Lee, Shadow Hills, CA (US); Leslie Jack Bodin, Pasadena, CA (US)

(73) Assignee: Leetronics Corporation, Shadow Hills, CA (US)

( * ) Notice: Subject to any disclaimer, the term of this patent is extended or adjusted under 35 U.S.C. 154(b) by 896 days.

(21) Appl. No.: 09/703,237

(22) Filed: Oct. 31, 2000

(51) Int. Cl.
*H04R 1/40* (2006.01)

(52) U.S. Cl. ..... 381/97; 381/59; 381/58

(58) Field of Classification Search ..... 381/97, 381/59, 58
See application file for complete search history.

(56) References Cited

U.S. PATENT DOCUMENTS 3,067,297 A 12/1962 Fink
3,148,287 A 9/1964 Bauer et al.
3,206,550 A 9/1965 Fink
3,548,321 A 12/1970 Duquesne
3,840,817 A 10/1974 Seki
4,648,113 A * 3/1987 Horn et al. ..... 381/1
4,691,358 A 9/1987 Bradford
4,908,868 A 3/1990 McTaggart
5,319,714 A 6/1994 McTaggart
6,681,019 B1 * 1/2004 Kitano et al. ..... 381/59

* cited by examiner

*Primary Examiner*—Huyen Le
*Assistant Examiner*—Justin Michalski
(74) *Attorney, Agent, or Firm*—Gregory L. Roth

(57) ABSTRACT

A low cost, reliable and accurate audio frequency phase detection system and method includes an audio signal source generating an audio frequency test signal and a phase detector detecting phase reversals in the audio frequency test signal. The signal source may be an active, real time signal generator or a recorded media player playing back a prerecorded signal. The test signal is provided to a user system while the phase detector determines whether or not a phase reversal has occurred in the test signal between the input and output of the user system and illuminates a green or red LED to indicate whether or not a phase reversal has occurred. The test signal includes a lower frequency signal component and a higher frequency signal component that provides a marker for testing the phase of the lower frequency signal component.

20 Claims, 9 Drawing Sheets

10
12
SIGNAL SOURCE
20
16
USER AUDIO SYSTEM
22
14
PHASE DETECTOR
54
56
60
RECORDED MEDIA PLAYER (CD)
70
72
74
76
78
80
90
62
AMPLIFIER
64
66
84
116
12A
SIGNAL SOURCE
12B
SIGNAL SOURCE
100
102
104
110
112
120
92
94

AUDIO SIGNAL PHASE DETECTION SYSTEM AND METHOD

BACKGROUND OF THE INVENTION

Proper operation of an audio system requires the maintenance of a correct signal phase to all speakers in the system. For optimum sound quality, a proper phase relation ship should be maintained both between each input and the signal processor (e.g., amplifier) as well as between the signal processor and each output. A positive pulse amplitude at a system input should produce a corresponding positive pulse amplitude at each system output, such as each speaker driver and the acoustic output signal from each speaker. If a phase reversal occurs, the input may still produce an intelligible output, but the output will experience a deterioration in sound quality.

Similarly, each speaker should be in phase with all of the other speakers. If two or more speakers are out of phase with each other, the acoustic waves from different speakers will experience destructive interference and the sound quality will be seriously degraded.

While maintenance of proper phase relationships among audio signals should be technologically feasible, in practice this is a significant problem. The problem is particularly acute when modular units in an audio system are acquired from different manufacturers. There are no uniformly adopted standards for maintaining correct signal phase across connector jacks or even between inputs and outputs. Consequently, it is not unusual to find that phase polarities have been reversed between different speakers within a system or even between components within a system.

Recording systems with multiple microphones should be phased such that a positive pressure change (increase in pressure) at each microphone will produce a positive voltage into the recording system and, ultimately, a positive pressure change at each speaker output upon playback. The lack of standards for manufacturing cable connectors can cause polarity connection errors which must be corrected before a recording session begins.

While systems do exist to detect phase reversals, these systems tend to be relatively expensive. Such detectors are particularly expensive in the context of a nonprofessional who may change an audio system relatively infrequently to add a new component or update an existing component. A need thus exists for apparatus and methods to quickly and inexpensively check the phases of audio signals at or between various locations in an audio system, whether for a home system having relatively few audio sources and speakers or for a professional system, such as an audio mixing system or an amphitheater or auditorium having multiple sources and speakers.

SUMMARY OF THE INVENTION

An inexpensive, yet accurate, audio signal phase detection system and method in accordance with the invention for detecting signal phase reversals within an audio system includes an audio signal source generating an audio signal having a first frequency component having a selected polarity that is marked by a second frequency component that is distinguishable from the first frequency component, the audio signal source being coupled to provide the audio signal to the audio system; and a phase detector coupled to receive a representation of the audio signal from the audio system, the phase detector detecting the marking of the first frequency component by the second frequency component and providing an indication as to whether or not the first frequency component has the selected polarity at the occurrence of the mark.

The signal source may be either a recorded medium such as a compact disk (CD), digital versatile disk (DVD) or an audio tape having a prerecorded test signal. Alternatively, the audio signal source may be an active signal generator.

One implementation of an active signal generator includes a microcontroller generating the test signal waveforms in a digital representation, a digital to analog converter converting the digital representation of the test signal to an analog representation and an amplifier amplifying and filtering the analog representation of the test signal to provide an output analog signal. The audio signal source generates the first frequency component as a sine wave having a frequency in the range of 100 to 300 Hertz. The frequency should be within the frequency range of the audio system, yet low enough that the first frequency component is readily distinguishable from the second, higher frequency component that is also within the frequency range of the audio system. Selection of a signal frequency in this low frequency range permits testing of the low frequency response of the audio system, which may invert the phase of low frequency signals if the low frequency response is inadequate.

The second, higher frequency component is implemented in a preferred embodiment as a 2 KHz sine wave that is modulated with the positive half cycle of a 400 Hertz sine wave. The integer frequency ratio of 5:1 enables exactly 5 half cycles of the 2 KHz signal to occur during each positive half cycle of the 400 Hertz signal. This enables both the 400 Hertz half cycle and the 2 KHz signal to begin and end at zero magnitude so as to minimize the generation of high frequency signal components. Modulation of the 2 KHz signal with the positive half cycle of the 400 KHz signal further reduces the generation of high frequency components. Signal filtering requirements within the signal source are thus reduced.

Short bursts of the second, high frequency signal are added to the first, low frequency signal during portions of selected cycles of the first, low frequency signal that occur near the positive peak of the low frequency signal to mark the positive half cycle of the first, low frequency signal (alternatively, the negative half cycle could be marked). Because many speakers produce a physical resonance or ringing in the higher frequency ranges around 2 KHz, it is desirable to generate the second, higher frequency marking signal no more frequently than 100 times per second and more preferably, no more frequently than 50 times per second. This affords time for the resonance from one marking pulse to decay before a next marking pulse is generated.

Thus, at a frequency of 150 or 200 Hertz for the first, lower frequency signal, the positive half cycle may be marked only every 3rd or 4th cycle while every second positive half cycle may be marked for a first, lower frequency signal having a frequency of 100 Hertz. The limiting of the repetition rate for the marking signal is particularly important when the phase detector is acoustically coupled to the audio system through a speaker output from the audio system and a microphone input to the phase detector.

Several alternatives are available for coupling the test signal to the audio system. In a preferred arrangement for testing speakers, one or more test signals is recorded on a recording medium such as a compact disk (CD), a digital versatile disk (DVD) or magnetic tape. The recording medium is then played back by the audio system to provide the test signal input. Alternatively, an active signal source may be electrically or acoustically coupled to the audio system to provide the test signal if no recording medium playback module is available. In either case the phase detector is either electrically coupled to an output speaker driver signal or is acoustically coupled to one of the speakers while the other speakers are isolated from the speaker being tested to prevent interference with the acoustic output signal from the speaker being tested.

Alternatively, a speaker output from the signal source may be acoustically coupled to a microphone input to the audio system for testing the phase of the microphone coupling. In this configuration electrical coupling of the phase detector to the amplifier is preferred over acoustic coupling to a speaker to avoid the phase shift and other distortion and signal losses that result from two acoustic couplings.

The phase detector includes green and red light emitting diodes (LED's). If the mark provided by the second, higher frequency component of the test signal occurs while the first, lower frequency component of the test signal is positive, there has been no phase reversal and the green LED is illuminated. If the mark occurs while the first, lower frequency component is negative (the polarity is opposite that of the original test signal), the signal phase has been reversed and the red LED is illuminated. The phase detection system thus provides an indication to an operator as to whether or not the phase of the test signal has been inverted by the audio system being tested.

In a particular embodiment, the phase detector includes a high pass filter isolating the second, higher frequency test signal component, a low pass filter isolating the first, lower frequency component, a detector or sampling circuit indicating when a marker occurs during a positive or negative half cycle of the first, lower frequency signal, a green holding circuit or low pass filter coupled to drive the green LED when the marker occurs during a positive half cycle of the lower frequency signal and a red holding circuit or low pass filter coupled to drive the red LED when the marker occurs during a negative half cycle of the lower frequency signal. The phase detector includes both microphone and electrical connector inputs and may optionally be coupled to receive a representation of the test signal from the audio system by acoustic coupling from an output speaker of the audio system to the microphone of the phase detector, by electrical connection of a speaker drive signal to the phase detector or by other suitable coupling.

In a method of phase testing in accordance with the invention, multiple low frequency test tones are provided to a user system. The low frequency response of a speaker or speaker system can be qualitatively determined by determining how low the input test frequency can become before a phase reversal occurs.

BRIEF DESCRIPTION OF THE DRAWINGS

A better understanding of the invention may be had from a consideration of the following Detailed Description, taken in conjunction with the accompanying drawings in which.

DETAILED DESCRIPTION

Figures 1, 3, 4:
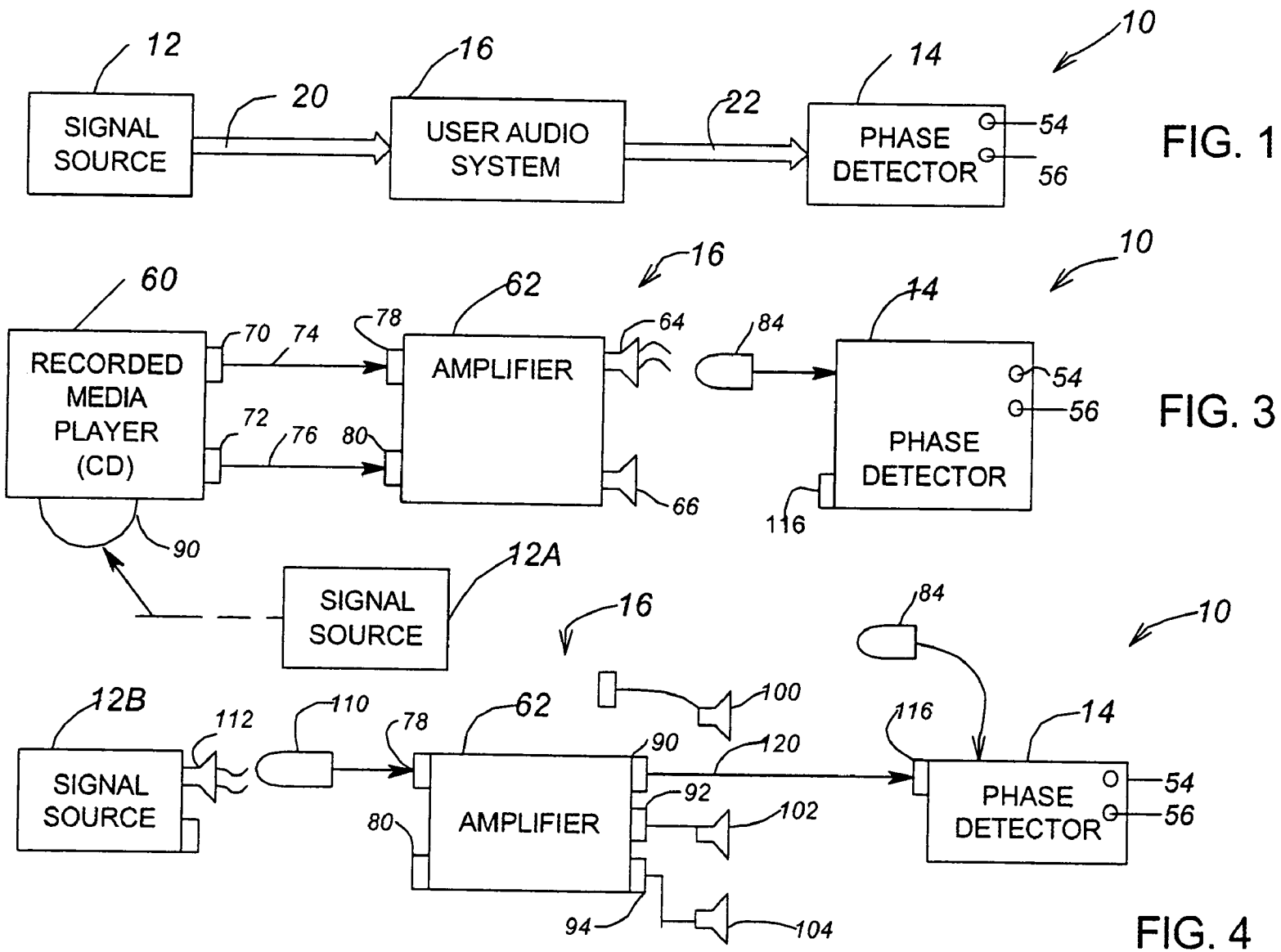
FIG. 1 is a block diagram representation of an audio signal phase detection system and method in accordance with the invention.
FIG. 3 is a block diagram of a specific arrangement for coupling a signal source and phase detector to an audio system in accordance with the invention for the purpose of testing audio signal phasing between an amplifier and a speaker of the audio system.
FIG. 4 is a block diagram representation of an alternative coupling arrangement of a signal source and phase detector to an audio system in accordance with the invention to an audio system.

Referring now to FIG. 1, an audio signal phase detection system 10 in accordance with the invention includes a signal source 12 and a phase detector 14 coupled to a user audio system 16. A connection 20 represents a generalized coupling of a test signal generated by signal source 12 to the user audio system while a connection 22 represents a generalized coupling of a representation of the test signal produced by user audio system 16 in response to the original test signal to the phase detector 14. Audio system 16 may be a simple audio amplifier component of a home entertainment system, a complete audio video entertainment system, a professional system having both audio and video portions, a complex multi-input, multi-speaker audio system for a theater or amphitheater or other audio system or audio portion of a user system for which a user desires to test for signal phase reversals between an input and an output.

Figure 2:
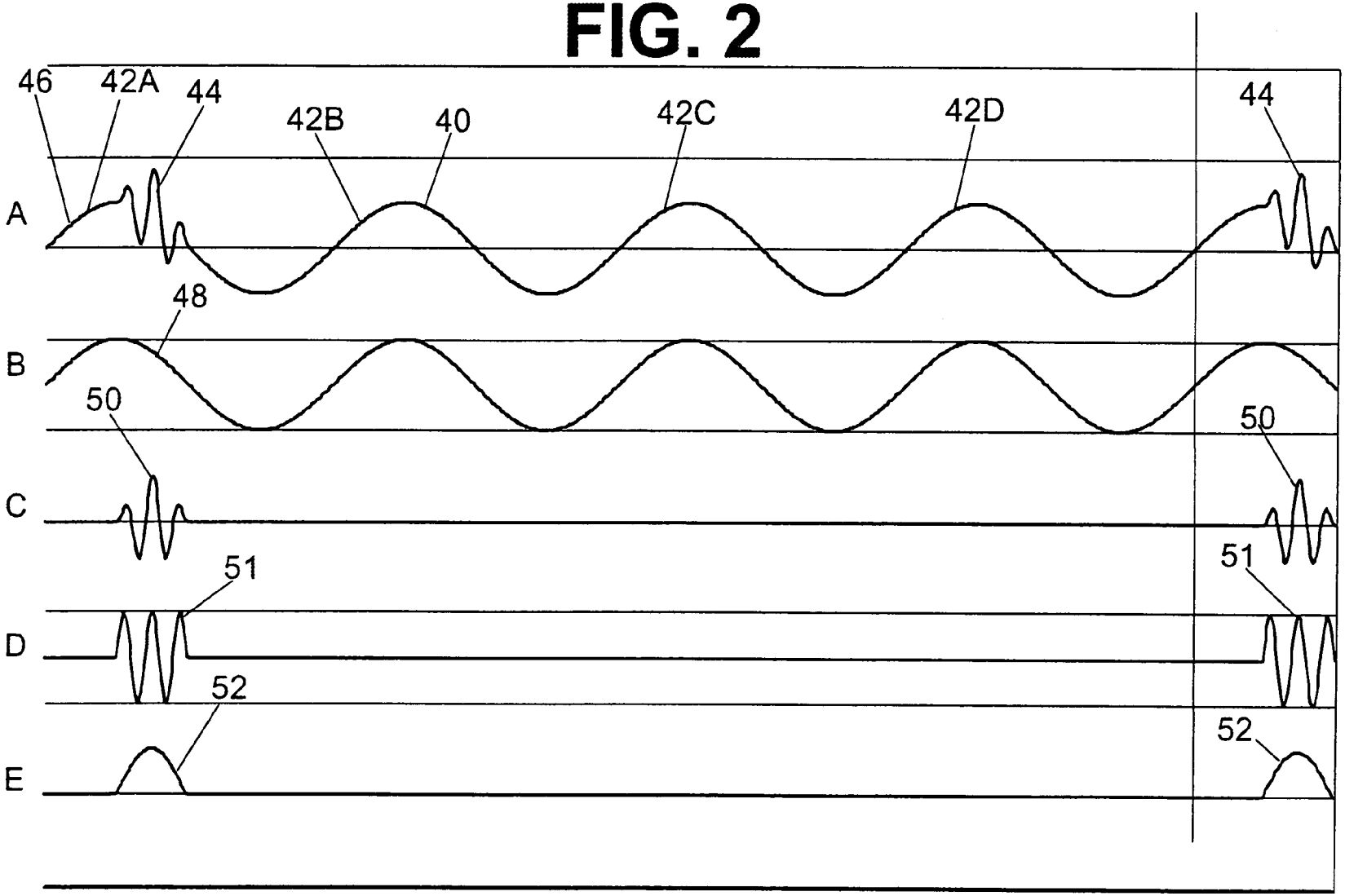
FIG. 2 is a graphical representation of a test signal used in the phase detection system and method shown in FIG. 1 as well as certain components of the test signal.

As shown in FIG. 2A, the signal source 12 generates a test signal 40 with at least some portions of the test signal having a selected polarity, i.e., positive or negative. The particular test signal 40 illustrated in FIG. 2A is generated by an active waveform generator that generates the test signal 40 in "real time" as the signal is used for testing an audio system 16. It will be appreciated that test signals with varying frequencies and phase relationships can be either generated by a "real time" active waveform generator as the test signal is used or stored on a storage medium and reproduced from the storage medium during a test.

Test signal waveform 40 is generated as a repetitive sequence of 4 cycles 42A–42D of a 200 Hertz sine wave. One of the 4 cycles (the first one 42A in the present example) is marked a the higher frequency marker signal component 44. That is, the first positive half cycle 46 and thereafter every 4th positive half cycle of test signal 40 is marked with the higher frequency marker signal component 44.

The repeating sequence of test signal 40 is a composite of two signal components. The first component is a sequence of 4 cycles of a 200 Hertz sine wave 48, which is shown in FIG. 2B. The second component, which serves as the marker, is a 2½ cycle burst of a higher frequency 2 KHz sine wave 50, which is shown in FIG. 2C. Test signal 40 represents the result of adding marker burst 50 to the positive half cycle 46 of the first 200 Hertz sine wave cycle 42A. The higher frequency marker component 50 is added to the positive half cycle 46 of the first cycle 42A of the lower frequency component beginning at the positive peak or 90 degree point to form marker signal component 44. Marker signal component 44 has a duration of ¼ cycle or 90 degrees with respect to the lower frequency component 48 and thus extends from the 90 degree point to the 180 degree point. The frequency separation between lower frequency signal component 48 and the higher frequency marker signal component 50 is not critical, but should be sufficient to enable phase detector 14 to distinguish the two components with inexpensive circuitry. At the same time, both the lower frequency signal component 48 and the higher frequency marker signal component 50 should be within frequency range of a typical audio system 16.

Higher frequency marker signal component 50 represents the result of modulating 2½ cycle of a 2 KHz sine wave 51 as shown in FIG. 2D with a positive half cycle 52 of a 400 Hertz sine wave as shown in FIG. 2E. Mathematically, the modulation is equivalent to multiplication and reduces filtering requirements in the signal source 12 by reducing unwanted frequency components. To further minimize high frequency components and attendant filtering requirements, it is desirable that both the 400 Hertz positive half cycle envelope 52 and the 2 KHz burst 51 begin and end concurrently, both with a value of zero. This can occur if the high frequency marker is an integer multiple of the lower frequency envelop such as having a frequency ratio, 2000:400 or 5:1 in the case of the sine waves 51 and 52.

The test signal 40 can be either prerecorded on a medium such as a compact disk (CD) or may be generated by an active signal generator in "real time" as a phase test is being conducted. A more sophisticated signal generator is economically more practical in the case where a single signal generator is used to record test signals on many CD's than in the case where a separate signal generator is provided with each phase detector.

This phase position of marker signal component 44 allows the marker signal component 44 to become approximately centered in the positive half cycle 46 in the acoustic representation of the test signal that is communicated to the user system 16. The phase position is shifted in the acoustic representation because inexpensive speakers tend to impose a lagging phase shift with the phase shift being greater for lower frequency signals such as lower frequency signal component 48. It will be appreciated that marking negative half cycles of 200 Hertz lower frequency wave form component 48 would be equivalent to marking the positive half cycles if the marking of the opposite polarity half cycles were properly accounted for by the phase detector 14. The test signal 40 can be represented by the following equation (1):

$$\text{Test Signal } 40 = A*\sin(200*k*i) + B*sq(ph_strt, ph_end)*\sin(400*k*[i-ph_strt])*\sin(2000*k*[i-ph_strt]) \quad (1)$$

where A is the peak magnitude of the 200 Hertz sine wave signal component 48, for instance 1. i is an incrementing or counting variable that accumulates to 140 counts for each cycle of lower frequency signal component 48, whether the component be for the first, marked cycle or one of the subsequent 3 unmarked cycles, and k is the increment magnitude for each count, which is $2\pi/140=0.04488$ radian or 2.57 degrees per increment in the present example. At a counting rate of 27,777 counts per second, i divides each marked and unmarked cycle of the lower frequency 200 Hertz sine wave 48 into 140 counts. B is the peak magnitude of the 400 Hertz half cycle signal 44 and is selected to produce a test signal in which the peak magnitude of the marker approximately equals the peak magnitude of the lower frequency signal component 48 in the acoustic representation of test signal 40 generated by a speaker. The term sq(ph_strt,ph_end) represents a square wave gating pulse signal that has a value of one during the occurrence of the marker burst 44 and a value of 0 at other times. The square wave gating pulse need not actually be generated, but is used in the equation to show that the second term is zero except during the ¼ cycle of lower frequency signal component 48 in which the marker 44 is produced. The term ph_strt has a value of 36(1+140/4) and introduces a phase shift of the higher frequency 2 kHz signal component 51 and its half cycle modulating envelope 52 relative to the lower frequency signal component 48 so that the higher frequency signal component 44 will start at 90 degrees and have a value of zero at the 90 degree and 180 degree points of lower frequency signal component 48.

In the case of a signal generator generating an acoustic test signal, B is approximately 0.12 to account for the substantial attenuation of the lower frequency signal by a small, inexpensive speaker. When the test signal is prerecorded, as on a CD, B can equal A or 1 since the electronically produced test signal need not experience the same low frequency attenuation that an acoustically produced signal experiences.

The 2 KHz bursts 44 tend to create a physical resonance or ringing in some speakers that might be interpreted as a false marking signal by the phase detector 14. To reduce the occurrences of false detection of the marking signal that results from speaker resonance, the 2 KHz burst is preferably repeated no more than 100 times per second and more preferably no more than 50 times per second. In the present example, every fourth positive half cycle 46 of 200 Hertz test signal sine wave signal component 48 is marked. This results in a marking repetition rate of 50 times per second in the preferred example. In an actual application, the maximum repetition rate for proper operation varies with the construction and mounting of a particular speaker that is being tested.

Phase detector 14 has a user interface in the form of a green light emitting diode (LED) 54 and a red LED 56. If phase detector 14 detects a positive polarity at the occurrence of marker 44 green LED 54 is illuminated and if phase detector 14 detects a negative polarity at the occurrence of marker 44 red LED 56 is illuminated.

Referring now to FIG. 3, the phase detection system 10 is shown with the manner of coupling to the user audio system 16 illustrated in greater detail. In this configuration the user audio system 16 includes a recorded media player 60 in the form of a compact disk (CD) player and an amplifier 62 that drives stereo speakers 64,66. Player 60 has left and right stereo output connectors in the form of jacks 70, 72 which are connected by audio signal carrying wire pairs 74, 76 to left and right stereo input connectors on amplifier 62 in the form of jacks 78, 80. Phase detector 14 includes a microphone 84, which may be located within the housing of phase detector 14, and which is acoustically coupled to receive the output of speaker 64 for the purpose of testing the signal phase relationship between player 60 and speaker 64.

In this configuration a signal source 12A is first used to provide a test signal similar to test signal 40 which is conventionally recorded on compact disk 90. In this arrangement signal source 12A may be relatively sophisticated since only one signal source 12A is needed to produce many of the compact disks 90, as opposed to providing a signal source for each phase detector 14. Signal source 12A may produce multiple variations of the test signal that may be recorded on different tracks of disk 90 to accommodate variations in the characteristics of different user systems 16. Signal source 12A may be conveniently implemented on a computer using a set of software programs which generate ".WAV" files which can then be transferred to a CD 90 or other recording medium.

While player 60 is playing the test signal recorded on disk 90, phase detector 14 is acoustically coupled to the output of speaker 64 through microphone 84. If user audio system 16 maintains the proper signal phase relationship from player 60 through amplifier 62 to speaker 64, green LED 54 will be illuminated to indicate the correct phase relationship. If the signal phase relationship is inverted, red LED 56 will be illuminated to indicate the inverted signal phase relationship.

To assure that the phase detector 14 responds only to the speaker being tested, all other speakers in the user system 16 should be disconnected or turned off. In the example of FIG. 3, speaker 66 should be turned off or otherwise acoustically isolated from phase detector 14 to prevent interference with phase detector 14.

In one arrangement 9 different test waveforms have been recorded on tracks 1–9 of compact disk 90. In each case, the peak amplitudes of the lower frequency sine wave and the 2 KHz modulated marker are the same. The different combinations of lower frequency and marker position allow for variations in the characteristics of different user systems. The various wave forms are summarized in Table 1.

TABLE 1

| Track | Lower Frequency | Marker Start Location (degrees) | Marker Occurrence Rate (cycles) |
|---|---|---|---|
| 1 | 150 | 45 | 1 in 3 |
| 2 | 200 | 22 | 1 in 4 |
| 3 | 200 | 45 | 1 in 4 |
| 4 | 200 | 90 | 1 in 4 |
| 5 | 150 | 22 | 1 in 3 |
| 6 | 150 | 90 | 1 in 3 |
| 7 | 100 | 22 | 1 in 2 |
| 8 | 100 | 45 | 1 in 2 |
| 9 | 100 | 90 | 1 in 2 |

The track 1 test signal provides a good combination of lower frequency and marker phasing the should work well for most applications. All but the lowest quality speakers should reproduce 150 Hertz with minimal phase shift. The 100 Hertz lower frequency signals permit testing of sophisticated system that should have and excellent low frequency response while the 200 Hertz waveforms permit the testing of systems with a poorer low frequency response. Once the correct phase is established in a good quality system using track 1, a sophisticated user can use the other tracks to make a qualitative estimate of the system performance.

For recording on a CD, the test signal is preferably generated in increments or increment multiples of the 44,100 Hertz sampling rate that is commonly used for CD's. A sine wave thus takes the form, $$\text{Signal}=\sin(2*\pi*f*i/44{,}100) \quad (2)$$

where f is the frequency of the wave and i is the number of counts or samples at 44,100 samples per second. A full cycle of a 150 Hertz lower frequency sine wave as on CD track 1 thus requires 294 samples. Similarly, the 400 Hertz envelope for the marker requires 110.25 (rounded to 110) samples for a complete cycle or 55 samples for a half cycle. Therefore, the marker burst has a duration of 55 samples or counts. The ¼ cycle or 90 degree point on the 150 Hertz sine wave is 294/4=73.5. To center the marker burst on the positive peak, the burst should therefore extend from count 51 to count 106. Because the test signal is electrically coupled to the amplifier 62 in this configuration and need not pass through an inexpensive speaker before reaching amplifier 62, the marker burst can be centered on the positive peak of the lower frequency signal and need not be delayed.

Referring now to FIG. 4, there is shown an alternative arrangement for coupling signal phase detection system 10 to a user audio system 16. The user audio system 16 includes an amplifier 62 having left and right input connectors in the form of jacks 78, 80 and 3 speaker output connectors in the form of jacks 90, 92 and 94 which in turn connect by electrical wire pairs to speakers 100, 102 and 104. User system 16 further includes a microphone 110 which is connected by an electrical wire pair through input jack 78 to amplifier 62. Signal source 12B includes a speaker 112, which may be either included within the housing of signal source 112 or externally connected. Speaker 112 is placed in sufficiently close proximity to microphone 110 that it is acoustically coupled to microphone 110.

In addition to the built in microphone 84, phase detector 14 includes an input connection in the form of jack 116. Speaker 100 is temporarily unplugged from amplifier 62 and an electrical wire pair 120 is plugged into output jack 90 and input jack 116 to provide electrical signal connection between amplifier 62 and phase detector 14. Jack 116 may be a 3.5 mm phone jack. When an adaptor is plugged into jack 116 microphone 84 is disconnected internally. One of several different adaptors may be used to connect phase detector 14 to amplifier 62. As an alternative to wire pair 120, an adaptor can have a pair of banana jacks at the detector jack 116 end into which leads with clips are plugged. The clips may be clipped onto the leads of a speaker 100 that is being tested without removing the speaker 100. Other alternative adaptors that plug into detector 116 can have either an RCA jack which fits most home systems, a stereo ¼ inch phone jack or an XLR connector that connects to most professional sound mixing boards.

The configuration of FIG. 4 enables the signal phase detection system 10 to test the phase connection between microphone 110 and amplifier 62. Signal source 12B generates the test signal 40 and outputs test signal 40 through speaker 112, which is acoustically coupled to microphone 110. The test signal 40 is picked up acoustically by microphone 110, amplified by amplifier 62 and output in the form of an electrical signal representation to speaker jack 90. From speaker jack 90 wire pair 120 caries the electrical representation of test signal 40 to input jack 116 of phase detector 14. Phase detector 14 then analyzes the representation of test signal 40 received at input jack 116 and illuminates green LED 54 if marker 44 occurs properly at positive polarity portions of the received representation of test signal 40 and illuminates LED 56 if marker 44 occurs at negative polarity portions of the received representation of test signal 40.

While phase detector 14 could alternatively be acoustically couple to amplifier 62 through one of the speakers 100,102,104 and microphone 84, such a connection would not enable a determination as to whether any polarity reversal occurs between the microphone 110 and amplifier 62 or between amplifier 62 and the speaker, unless proper polarity for one of these connections had been previously confirmed. Further, such a configuration could not detect a double polarity reversal between microphone 110 and amplifier 62 and between amplifier 62 and the speaker, e.g. speaker 100. In addition, the double acoustical coupling between speaker 112 and microphone 110 and between speaker 100 and microphone 84 would significantly increase signal losses and distortion would render any phase determination suspect. To reduce signal losses and distortion, an electrical connection is preferably used whenever practical.

Figure 5:
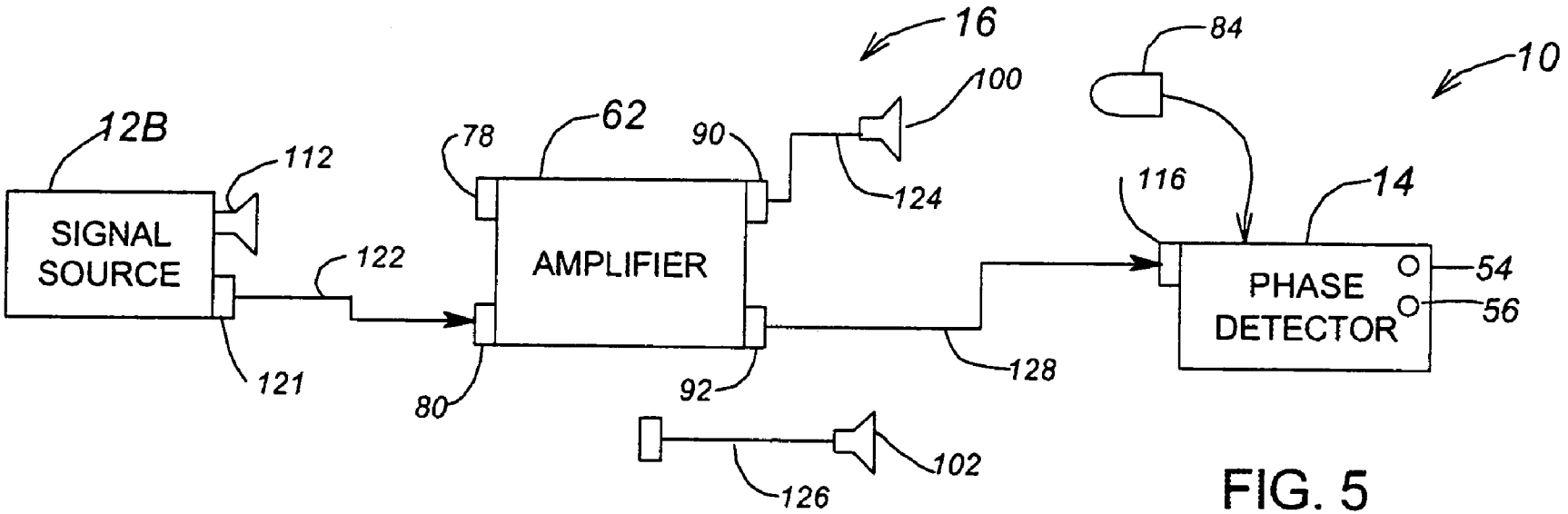
FIG. 5 is a block diagram representation of a further alternative coupling arrangement of a signal source and phase detector to an audio system in accordance with the invention.

Referring now to FIG. 5, the audio signal phase detection system 10 is normally coupled to a user audio system 16 having an amplifier 62 and two speakers 100, 102. Signal source 12B includes an output connector in the form of an audio jack 121 and amplifier 62 has an input connector in the form of an audio jack 78 for a left stereo audio signal and an input connector in the form of a jack 80 for a right stereo audio signal. A wire pair 122 provides an electrical connection between output jack 121 and input jack 80 for electrical communication of test signal 40 from signal source 12B to amplifier 62.

Amplifier 62 has output connectors in the form of jacks 90, 92 for stereo left and right audio output signals. Jack 92 is normally electrically connected to speaker 102 by wire pair 126 while jack 90 is electrically connected to speaker 100 by wire pair 124. Phase detector 14 has an input connector in the form of jack 116. For the purpose of testing, amplifier 62 speaker wire pair 126 is temporarily disconnected from jack 92 and a wire pair 128 provides electrical connection from output jack 92 of amplifier 62 to input jack 116 of phase detector 14.

The configuration of FIG. 5 permits testing for any phase reversal through amplifier 62. Test signal 40 is generated by signal source 12B and communicated by wire pair 122 to amplifier 62. Amplifier 62 amplifies test signal 40 and outputs an amplified electrical representation of test signal 40 through wire pair 128 to phase detector 14. Phase detector 14 determines whether or not marker 44 occurs during a positive polarity portion of the received representation of test signal 40. If yes, green LED is illuminated to indicate a correct phase relationship. If the marker 44 occurs during a negative polarity portion of the received representation of test signal 40 the red LED 56 is illuminated to indicate that amplifier 62 has caused a phase reversal between input jack 80 and output jack 92.

Figure 6:
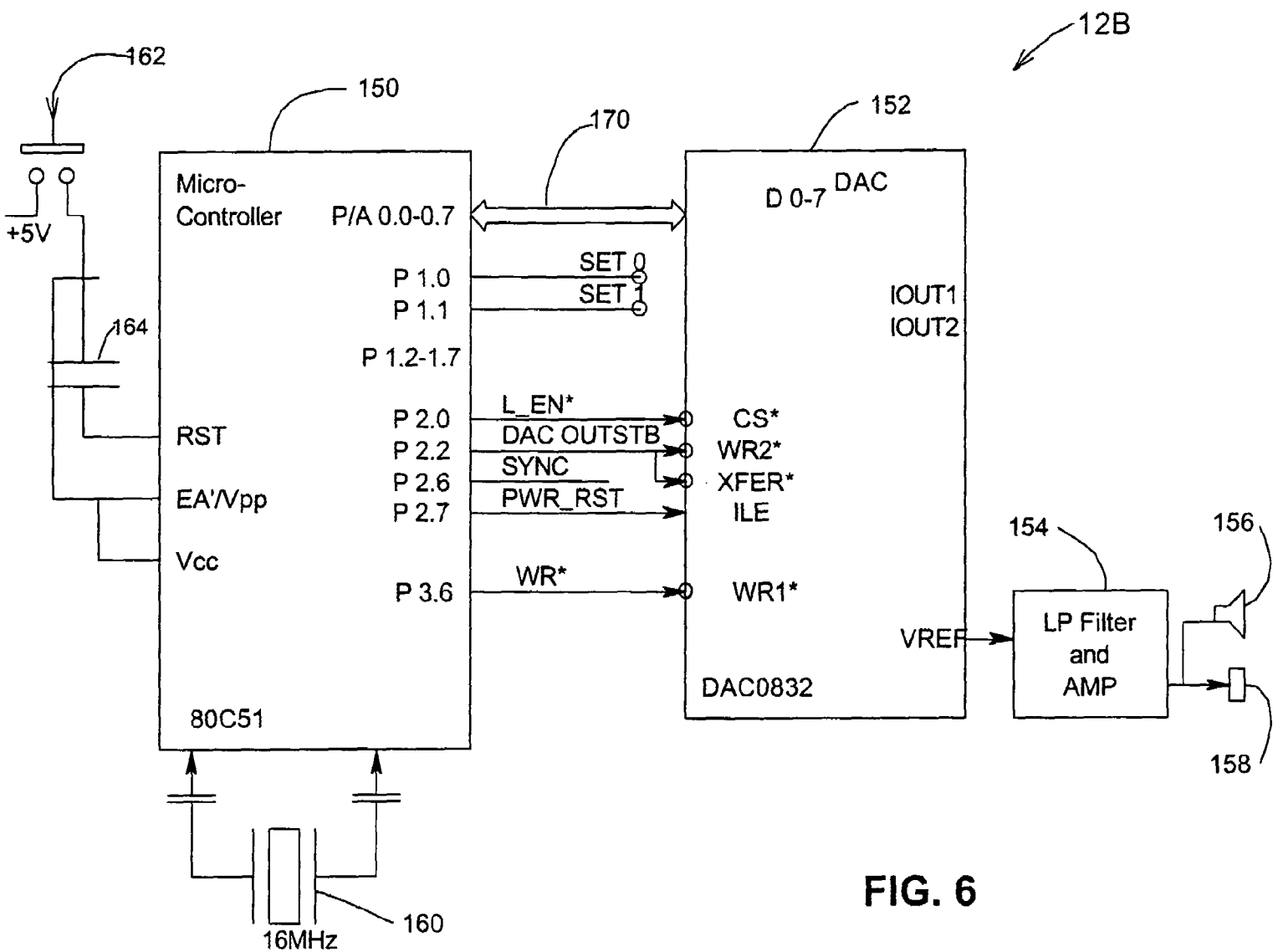
FIG. 6 is a block diagram and schematic representation of an active signal source used in the audio signal phase detection system and method shown in FIG. 1.

Referring now to FIG. 6, the signal source 12B includes an 80C51-1 microcontroller 150, a DAC0832 digital to analog converter (DAC) 152, a low pass filter and amplifier 154, a speaker 156 and an output connector in the form of a jack 158 that are driven by the output of L.P. filter and amplifier 154. A 16 MHz crystal 160 provides a frequency reference for microcontroller 150 while a push button switch 162 controls the application of power to the various components of signal source 12B. Microcontroller 150 is a single chip programmable digital data processor that operates in response a program stored on the single chip. While the power source is shown only as a +5 volt connection, power can be supplied from a battery through a voltage regulator, from a power supply connected to a.c. utility power or from another conventional power source.

In operation, microcontroller 150 outputs a series of magnitude values that define the shape of the test signal. These magnitude values are output from data port P0.0–0.7 to data bus 170, which connects to the data inputs of DAC 152. DAC 152 generates at output VREF a voltage signal commanded by the magnitude received at the digital data input. The signal output by voltage output VREF is communicated to L.P. filter and amplifier 154 and then to speaker 156 and output jack 158 for coupling to the user audio system 16. DAC 152 is operated in the voltage mode by connecting output IOUT1 to VCC, by connecting output IOUT2 to ground and by taking the signal output from output VREF.

The test signals may be stored in read only memory within microcontroller 150 as data representing a sequence of magnitudes defining the cycles of the output wave forms. Microcontroller 150 reads the sequence of magnitudes for a selected wave form and outputs the magnitudes to DAC 152. Thereafter, microcontroller 150 either repeats the same waveform cycle or reads a different sequence of magnitudes defining a different waveform cycle.

Operation of signal source 12B begins when a user depresses push button switch 162, which may be advantageously mounted on a protective case for signal source 12B. Upon actuation of switch 162 power is supplied to all components of signal source 12B and is also coupled through capacitor 164 to the reset input of microcontroller 150. Capacitor 164 supplies enough charge to maintain the power on reset condition for the minimum required time before a pull down resistor that is internal to the RST input of microcontroller 150 reduces the voltage at the RST input below the threshold level and enables microcontroller 150 to begin execution of a program stored internally in ROM.

Figures 7, 8:
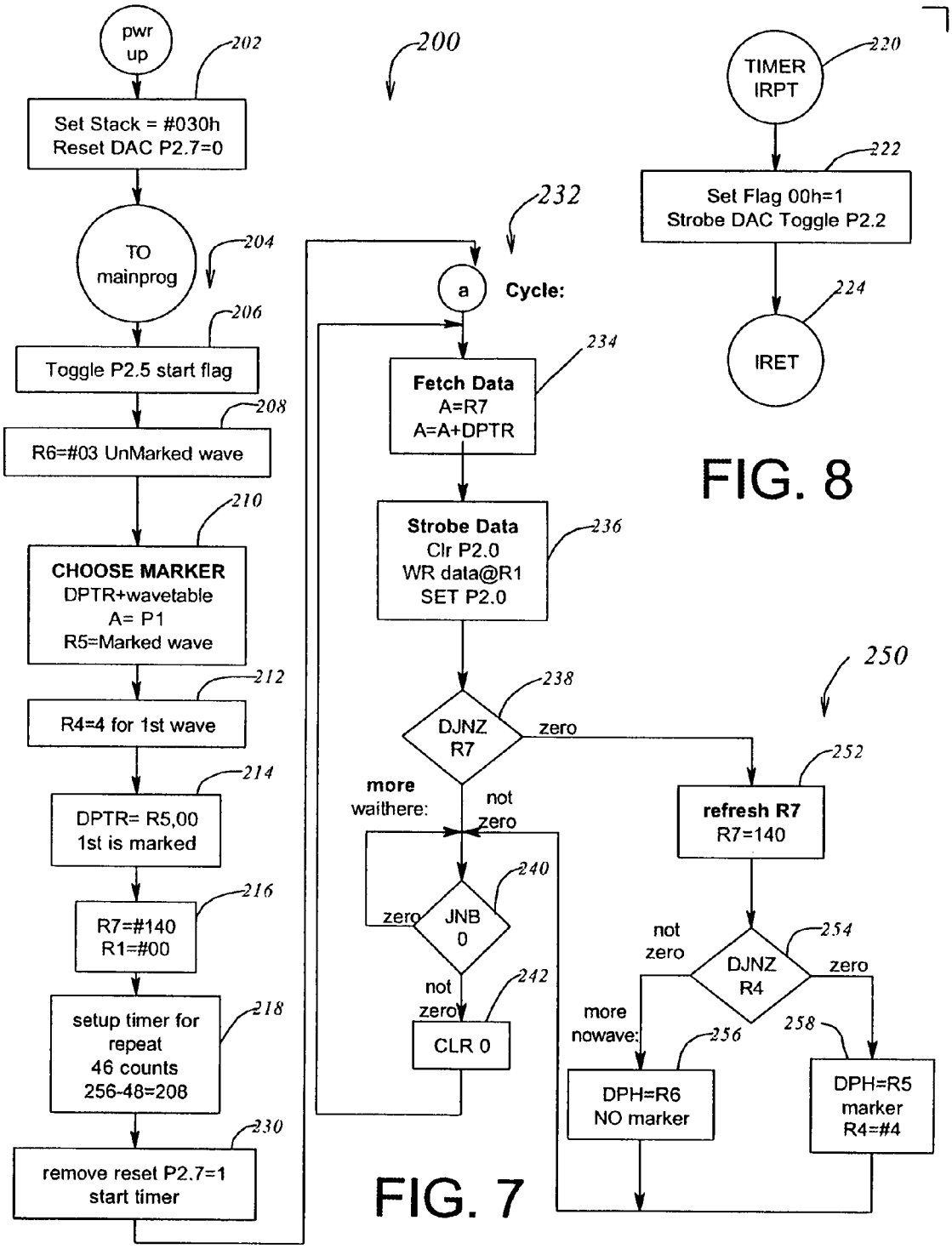
FIG. 7 is a flow chart of a program used in a microcontroller that is part of the signal source shown in FIG. 6.
FIG. 8 is a flow chart of an interrupt service routine used in the microcontroller that is part of the signal source shown in FIG. 6.

The program flow chart for tone generation program 200 operating microcontroller 150 is shown in FIG. 7, to which reference is now made. Upon termination of power on reset, at a set up operation 202, the stack pointer is set to the recommended location of 30 hex and port output bit P2.7 is set to 0 to generate a power on reset signal, PWR_RST, which is connected to the Input Latch Enable, ILE, input of DAC 152. Signal PWR_RST holds DAC 152 in a locked condition that prevents unwanted noise outputs while microcontroller 150 executes initialization procedures.

Next, a program initialization sequence 204 toggles output port P2.5 at procedure 206 to provide an external indication of program start that is useful for manufacturing testing. At procedure 208 register R6 is loaded with address 03 hex, which is the upper byte of address 0300 hex. Address 0300 hex is the lower boundary of a data array storing data defining one cycle of a 200 Hertz unmarked sine wave similar to sine wave 48 (FIG. 2B). A single full cycle of the sine wave (see sine wave 48 in FIG. 2B) is divided into 140 increments (140 tol) of 2.57 degrees each beginning at zero degrees. The magnitude of the sine wave at each increment is precalculated and stored in ROM data memory in sequence in reverse order beginning at location 0300 hex plus 1. That is, the value 0 plus 128 which occurs at zero degrees is stored at location 0300 hex plus 140 and the value −5.73+128=122.3 is rounded to 122 and stored at 0300 hex plus 1, corresponding to 357.43 degrees.

To match the sine wave to the 8 bit ROM storage of microcontroller 150, the sine wave values are normalized by multiplying them by a scale factor of 127 and shifting them upward by adding an offset of 128. Thus, a value of 128 is stored for points corresponding to magnitude 0 at 0 degrees and 180 degrees, a value of 255 is stored for the point corresponding to a magnitude of 1 at 90 degrees and a value of 1 (−127+128) is stored for the point corresponding to a magnitude of −1 at 270 degrees. DAC 152 proportions values of 0 to 255 between 0 and 5 volts, respectively, while capacitive coupling removes the DC bias and changes the signal range to ±2.5 volts.

Next, at procedure 210, register R5 is loaded with one of four memory addresses that in turn store the beginning address of one of four data sequences that define one of four different marked waves. Bits P1.0 and P1.1 of port P1 are tied to pullup resistors and can be selectively pulled low with jumpers at points SET0 and SET1 to identify one of four input states that correspond to four different combinations of phase positions and relative magnitudes of the marker 2 KHz frequency burst. Although other combinations are possible, the four selected combinations are:

11 200 Hz wave with 1:0.120 amplitude ratio marker at 90 degrees, 700 hex.

10 200 Hz wave with 1:0.120 amplitude ratio marker at 270 degrees, 600 hex.

01 200 Hz wave with 1:1 amplitude ratio marker at 90 degrees, 500 hex.

00 200 Hz wave with 1:1 amplitude ration marker at 270 degrees, 400 hex.

The amplitude ratio refers to the ratio of the peak amplitude of the 400 Hz envelope of the marker (see FIG. 2E, pulse 52) to the peak amplitude of the 200 Hz sine wave 48. The lower ratios are selected to accommodate the greater attenuation of the low frequency wave by the small, inexpensive speaker 156 (FIG. 6). The low ratio leaves the magnitudes of the lower frequency wave and higher frequency marker about the same in the acoustic wave actually output by the speaker. For an electrical output that does not experience the low frequency attenuation by the speaker, a magnitude ratio closer to 1:1 would be more appropriate.

Output jack 158 is preferably a mono jack, which switches the output signal from the speaker to the tip of a plug when the plus is inserted into the jack. In an advanced design, a stereo jack could be used for jack 158. In this case the ring contact could be used to allow the microcontroller to sense the presence of the changed output. The waveform could be changed to a different table [e.g., ratio 1:1 @ 45°] and the amplitude could be changed either in the wave table or by switching gain resistors at the input to the amplifier 154 using a FET switch controlled by the microcontroller.

In actual practice, combination 1,1 has been found adequate and the use of jumpers to select other marker combinations is not deemed necessary. Thus, the 1,1 inputs at port 1 cause register R5 to be loaded with the most significant byte (07 hex) of a memory address that in turn points to the starting memory address for a sequence of data that defines the magnitude sequences of the 200 Hz wave that is marked starting at 90 degrees with the marker having a duration of 90 degrees and thus continuing to the 180 degree phase point. The least significant byte is impliedly zero. The greater phase shift experienced by the lower frequency sine wave compared to the higher frequency marker results in the marker being approximately centered on the positive half cycle of the lower frequency wave in the acoustic test signal actually generated by the speaker 156.

Register R4 counts the cycle of 4 wave cycles that is required to generate a marked wave every fourth cycle. Register R4 is set to 4 at process 212. This causes the marked wave to be generated as the first wave form. As register 4 is successively decremented to 3, 2 and 1 three cycles of the unmarked wave are generated. Then register R4 is again set to 4 to repeat the cycle of 4 waves.

At procedure 214 the upper byte of the data pointer is loaded with the contents of register R5 and the lower byte is loaded with 00 hex. This causes the data pointer to point to the first memory location for the data sequence that defines the selected marked wave form. At procedure 216 a counter register R7 is set to decimal 140 to count the 140 increments that define a waveform and register R1 is set to zero so that it will point to port 0, which is used to communicate wave form values from microcontroller 150 to DAC 152.

At procedure 218 an automatic timer that is internal to microcontroller 150 is initialized and a timer register is set to 256−48=208. The timer automatically and repetitively counts from 208 to 255, at which point it resets the timer counter to 208 and generates an interrupt, causing the execution of interrupt service routine 220. A flow chart of interrupt service routine 220 is shown in FIG. 8. Interrupt service routine 220 executes procedure 222 before executing an interrupt return 224. At procedure 222, microcontroller 150 strobes previously set data from an input register to an output register of DAC 152 by toggling signal OUTSTB on port 2 output bit P2.2. Interrupt service routine (ISR) 222 also sets bit 00 in the flag register to 1 to inform the main program that data is being transferred to the DAC 152 output register so that the program can load the next output value into the DAC 152 input register.

The provision of separate input and output registers within DAC 152 enables data to be transferred to the DAC by microcontroller 150 with low precision timing. Data is transferred to the input register and then the microcontroller 150 simply waits for the data to be transferred to the output register. The timing is not critical so long as the new data is loaded before the transfer occurs. Thereafter, the automatic, high precision timer generates an interrupt that causes the previously supplied data to be transferred from the inut register to the output register of DAC 152 and flag bit 00 is set to "1" to inform the main program that it can now load the next data byte into the DAC input register.

The timer increments the timing register every 12 cycles of the 16 MHz master clock or once every 750 nanoseconds. The 48 counts loaded into the timer register thus produce an interrupt every 0.75×48=36 microseconds. Each sine wave has a period of 140 interrupt intervals or counts established by loading a count of 140 into register R7 at procedure 216. This in turn corresponds to a period of 140×36=5.040 millisecond or a frequency of 198.4 Hertz, which is adequately close to the desired nominal frequency of 200 Hertz for the lower frequency sine wave 42.

Having completed the initialization, the reset of DAC 152 is removed by writing a 1 to port P2.7 and the automatic timer is started at procedure 230. The program then begins executing a continuous, repetitive cycles 232 at point "a" by outputting repetitive four cycle sequences having 1 marked waveform and 3 unmarked waveforms.

The repetitive cycle 232 begins with procedures 234, 236 which fetch a waveform data value from memory and write the value to the input register of DAC 152. The fetch procedure 234 writes the contents of register R7 (address offset counter) to the accumulator, A. The microcontroller 150 then adds the contents of the data pointer, DPTR, (previously initialized with the lowest address of the unmarked wave) to the offset already stored in A and uses this result to address memory. The fetched memory value is stored in the accumulator, replacing the address that was used to fetch the memory value.

The data value now stored in the accumulator is then written to the DAC 152 input register at procedure 236 by clearing output port bit P2.0 to force the data write signal, L_EN* active low and transfer the data value over port 0 and data bus 170 from the accumulator to the DAC 152 input register. The data write strobe signal, L EN* at port P2.0 is then set inactive high to complete the data transfer. Thereafter, at test procedure 238 register R7 is decremented and tested. If the decremented contents of register R7 are nonzero the microcontroller pauses at test procedure 240 and waits for the occurrence of the timer interrupt to transfer the previously written waveform data from the input register to the output register of DAC 152. At procedure 240 a jump on nonzero Flag Bit 0 test instruction causes the repeated execution of the instruction until the interrupt service routine 220 strobes the DAC 152 output register and sets flag bit 00 hex to "one" at procedure 222.

Thereafter, flag bit 0 is again cleared to 0 at procedure 242 and program execution returns to the beginning of cycle 232 to read the next data value from memory and write the data value to the input register of DAC 152. This time, however, counting register R7 has been decremented at procedure 238, causing the next data value in sequence to be transferred to DAC 152. It will be noted that data values defining a waveform are read from memory in descending order and therefore must be initially stored in descending order.

After all 140 values defining a waveform have been written to DAC 152, register R7 will be decremented to zero at procedure 238 and program execution will branch to a waveform cycle initialization sequence 250 to initialize the registers for the next waveform. At procedure 252 register R7 is again initialized to store a count of 140 and then at test procedure 254 the contents of cycle count register R4 are decremented and tested with a decrement and jump on nonzero instruction DJNZ R4. If the contents or Register R4 are not zero, procedure 256 loads the high byte of the data pointer with the contents of register R6 (03 hex), which points to an unmarked waveform (the low byte is left at 00) and program execution proceeds to test procedure 240 to wait for a timer interrupt.

If decrement register R4 procedure 254 results in a count of zero, procedure 258 is executed to begin a new cycle of generating 1 marked waveform and 3 unmarked waveforms. At procedure 258 the high byte of the data pointer is loaded with the contents of register R5, which contain the high byte of the starting address of the selected marked waveform 07 hex) and register R4 is reinitialized to a count of 4. Program execution then proceeds to procedure 240 to wait for a timer interrupt.

This repetitive cycle 232 of generating one marked waveform and 3 unmarked waveforms continues until power to the signal source 12B is terminated by deactuating push button switch 162.

Figure 9:
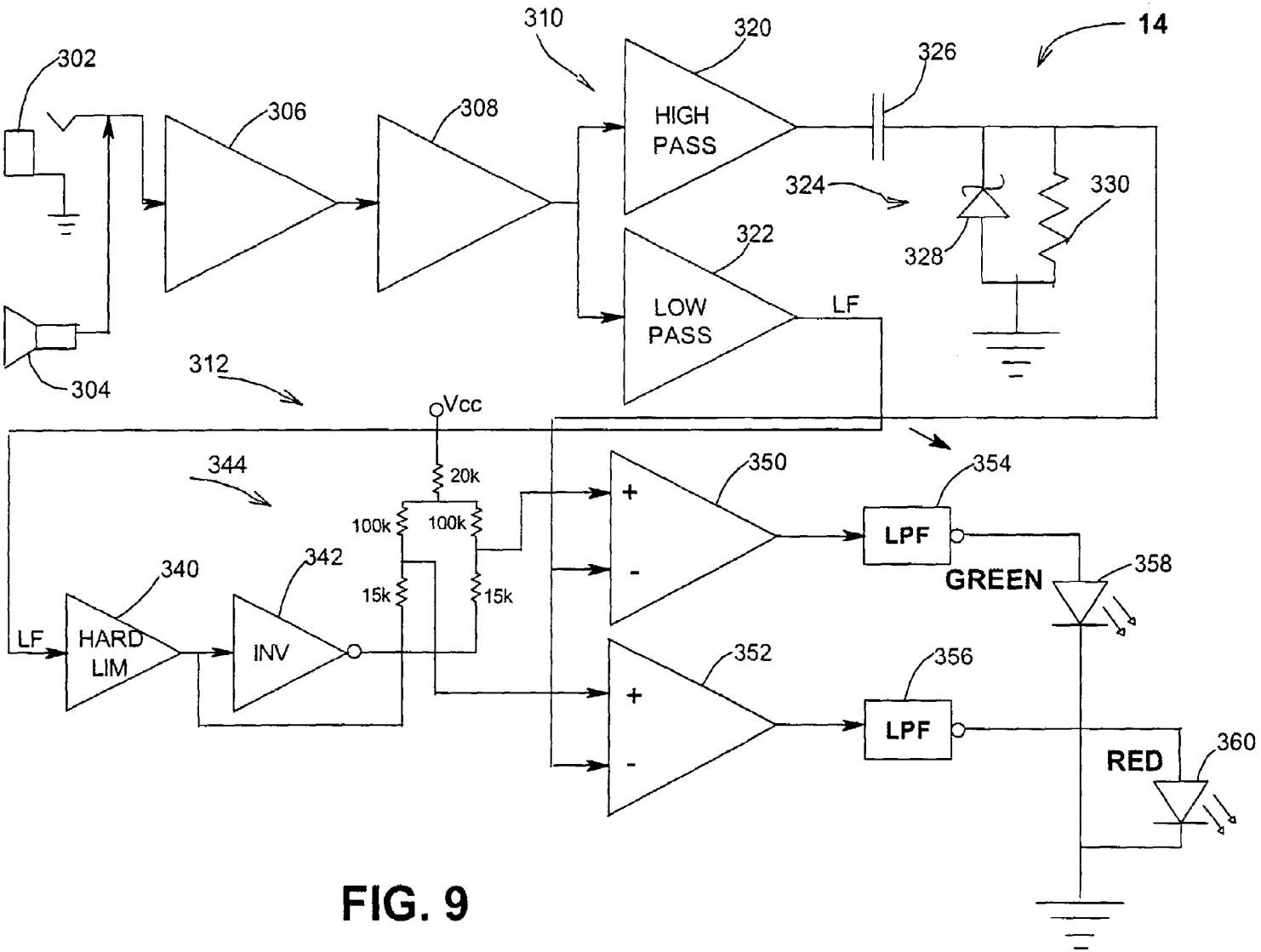
FIG. 9 is a block diagram and schematic representation of a phase tester used in the signal phase detection system and method shown in FIG. 1.
Figure 10:
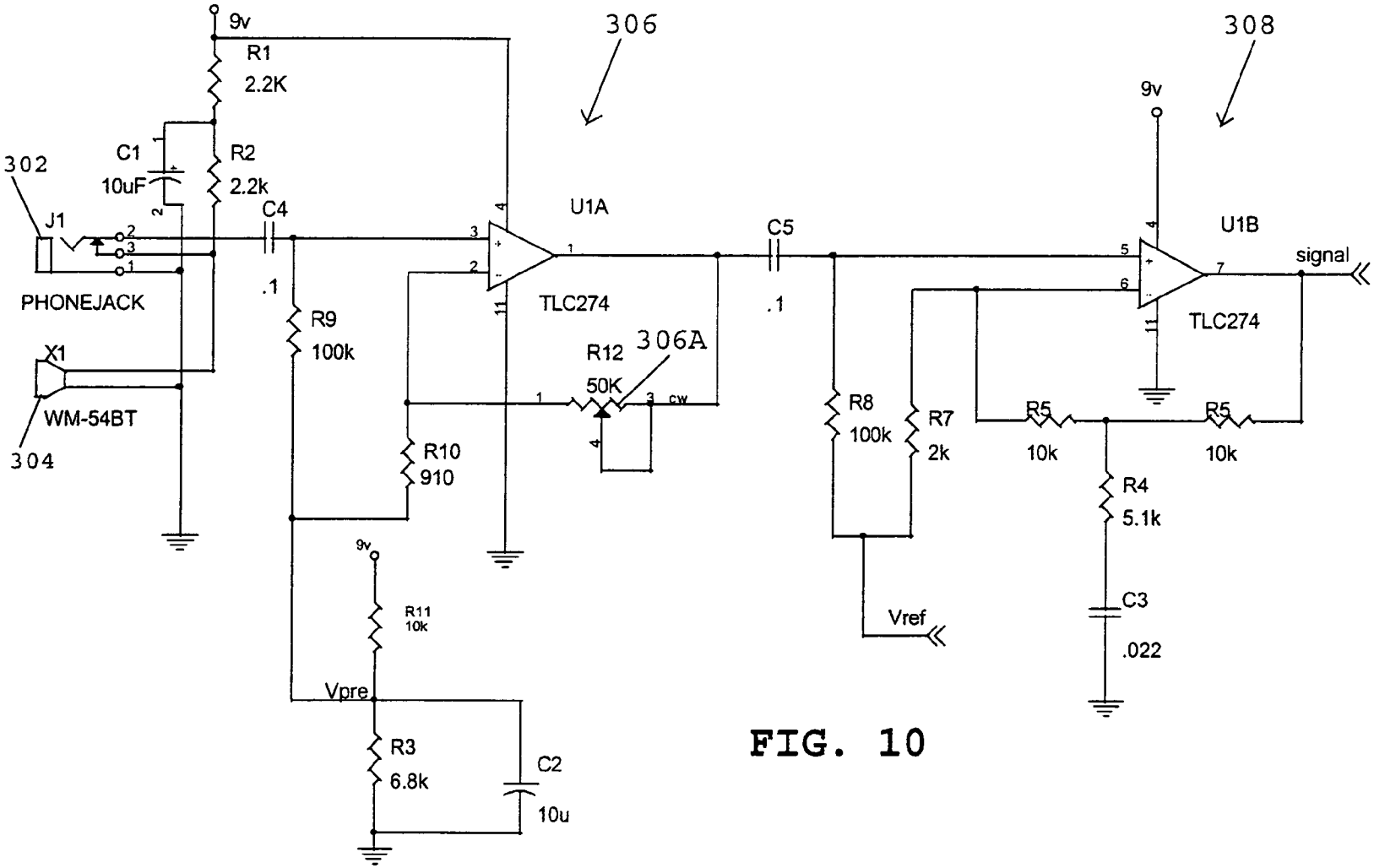
FIG. 10 is a detailed schematic representation of two amplifiers used in the phase tester shown in FIG. 9.

Referring now to FIGS. 9 and 10, the phase detector 14 includes signal inputs in the form of a phone jack 302 and a microphone 304, gain variable pre-amplifier 306, equalizer amplifier 308, a signal separator 310 and a detector 312. Phone jack 302 and microphone 304 are connected in such a way that a user may use one or the other, but not both simultaneously, because inserting a plug into jack 302 disconnects microphone 304. The gain variable pre-amplifier 306 has an adjustable gain of 7 to 54 db that is selectable by adjusting potentiometer 306A. The equalizer amplifier 308 has 6 db more gain at 2 KHz than at 200 Hertz. A d.c. reference voltage, Vref, is readily provided from the 9 volt battery source with a resistor voltage divider and provides a d.c. offset of +3.6 volts. This offset serves a an a.c. zero reference that allows the a.c. signals to swing above and below the reference voltage (a.c. plus and minus) without need for a second, negative voltage source.

Figure 11:
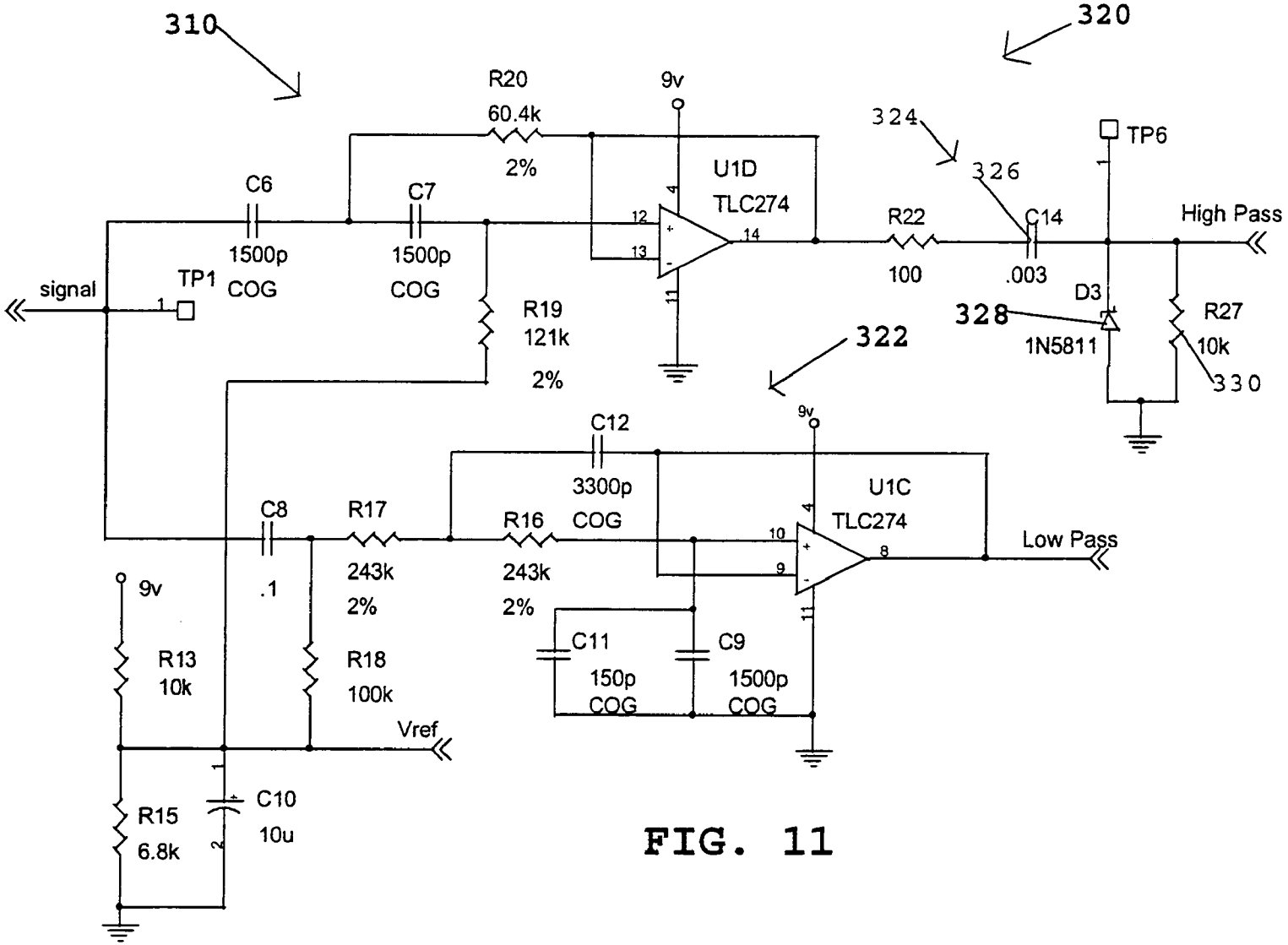
FIG. 11 is a detailed schematic representation of a signal separtor used in the phase tester shown in FIG. 9.

As further shown in FIG. 11, signal separator 310 includes a high pass filtering amplifier 320 that separates the higher frequency signal component from the audio frequency test signal by passing only the higher frequency signal component defining the 2 KHz marker and not the lower frequency signal. High pass filtering amplifier 320 has a −3 db cutoff frequency of 1100 Hertz and reduces gain at 12 db per octave below the cutoff frequency. To provide good isolation of the 200 Hertz lower frequency signal component, gain is reduced by 30 db at 200 Hertz.

Signal separator 310 further includes a low pass filtering amplifier 322 that separates the lower frequency signal component from the audio frequency test signal by passing the 100 to 200 Hertz lower frequency signal component but not the 2 KHz marker signal component. Low pass filtering amplifier 322 has a −3 db cutoff frequency of 250 Hertz and reduces gain at 12 db per Octave above the cutoff frequency. To provide good isolation of the higher frequency 2 KHz signal component, gain is reduced by 30 db at 2 KHz.

Signal separator 310 further includes a voltage doubling rectifier circuit 324. Voltage doubling rectifier circuit 324 is coupled between the output of high pass filter amplifier 320 and the higher frequency signal input to detector 312. Voltage doubling rectifier circuit 324 includes a capacitor 326, a Schottky diode 328 and a 10k ohm resistor 330. Capacitor 326 has an input side coupled to the output of high pass filtering amplifier 320 and an output side connected to the higher frequency input of detector circuit 312. Schottky diode 328 is connected to conduct current from ground to the output side of capacitor 326 while resistor 330 is connected in parallel with Schottky diode 328.

The voltage doubling rectifier circuit 324 doubles and rectifies the 2 KHz higher frequency signal component that appears at the output of high pass filter 320. As the output of high pass filter 320 goes negative, diode 328 conducts to clamp the output side of capacitor 326 near ground and charge capacitor 326. As the output of high pass filter subsequently goes positive, the output side of capacitor 326 experiences the positive voltage plus the approximately equal voltage from the previously accumulated charge. Thus, as the output of high pass filter 320 varies between, for example plus and minus 1.5 volts, the output side of capacitor 326 varies between plus 3 volts and 0 volts or ground.

Figure 12:
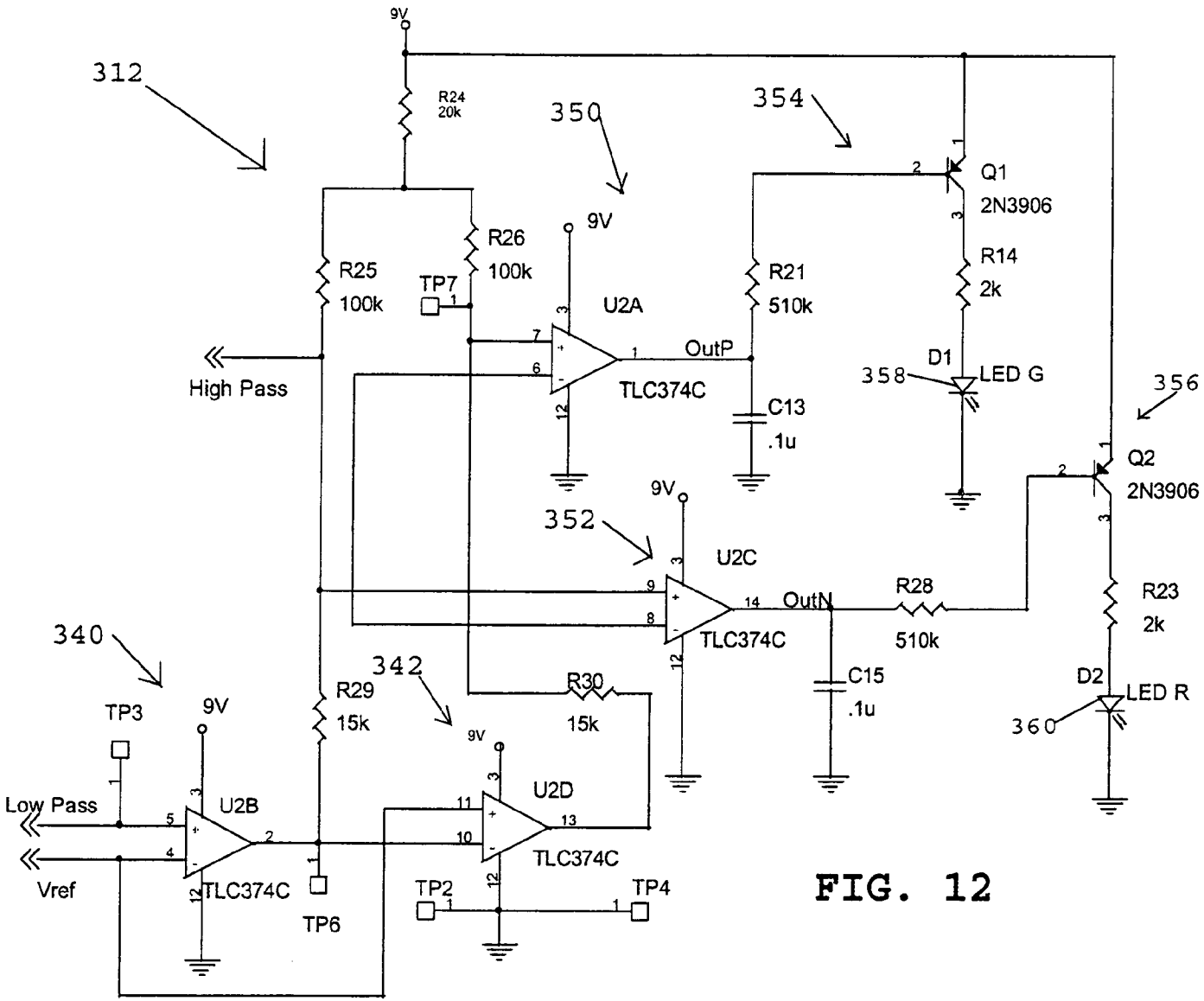
FIG. 12 is a detailed schematic representation of a phase detector used in the phase tester shown in FIG. 9.

Making further reference now to FIG. 12, detector 312 is responsive to the higher and lower frequency signal components and includes a hard limiter amplifier 340 connected to receive the low frequency signal component from the output of low pass filter amplifier 322 and an inverting hard limiter amplifier 342 having its input connected to receive the output of hard limiter amplifier 340. Detector 312 further includes green and red threshold detectors/comparators 350, 352, green and red LED drivers 354, 356 and green and red LED's 358, 360.

A test signal received through either microphone 304 or jack 302 is amplified by amplifiers 306, 308 and coupled to amplifiers 320, 322 which separate the lower frequency signal component from the 2 KHz higher frequency marker signal component. The lower frequency signal component should have a peak voltage at the output of amplifier 308 in the range of 1 to 4 volts and preferably a peak voltage of about 2 volts, which may be selected by the user by adjusting the gain of amplifier 306 by adjusting potentiometer 306A, which may be located with a thumbwheel adjustment extending through the protective case. This a.c. voltage is added to a d.c. bias of approximately +3.6 volts (Vref) at the output of low pass filter 322. A good rule of thumb is to adjust potentiometer 306A until one, but not both, of the indicator LED's 54, 56 is illuminated. The higher frequency marker signal component should have a peak voltage at the output of filter amplifier 308 in excess of ½ volt and preferably 1 to 2 volts.

Hard limiter 340 has a threshold voltage of about +3.6 volts, which corresponds to the d.c. bias on the output of low pass filter 322. Consequently, during the positive half cycle of the lower frequency signal component, LF, the input of hard limiter 340 exceeds the threshold, causing the output of hard limiter amplifier 340 to be driven high to a saturation voltage of about 9 volts when powered by a 9 volt battery to disable red threshold detector/comparator 352 and block the marker signal from passing there through. The output of hard limiter 340 is also connected to the inverting input of inverter 342, which also operates with a threshold of about +3.6 volt.

Thus as the low frequency signal component presents a positive half cycle, the output of hard limiter 340 goes high, thereby presenting a high voltage to both comparator 352 and inverter 342. This high voltage exceeds the threshold of inverter 342, thereby driving the output of inverter 342 toward 0 volts. Similarly, during a negative half cycle of the lower frequency signal component, the input to hard limiter 340 is below the +3.6 volt threshold, causing its output to go low toward 0 volts. This drops the input to inverter 342 below the threshold and forces the output to saturate high at about 9 volts.

The outputs of hard limiter 340 and inverter 342 are coupled respectively to the positive inputs of comparators 352, 350 through a resistor network 344, which reduces the voltge swing into the positive terminals of comparator 350 and 352 to a range of about 1 volt minimum and 7.7 volts maximum. As the output of hard limiter 340 or inverter 342 goes high, the input to respective red or green comparator 352, 350 is allowed to substantially respond to the high voltage and is correspondingly driven high to set a high threshold that causes the output to remain low and disable the associated red or green light emitting diode 360, 358, respectively. However, as the output of hard limiter 340 or inverter 342 goes low, the resistor network 344 clamps the input to the negative input of red or green comparator 352, 350, respectively at a threshold voltage of about 1 volt.

During the occurrence of a positive half cycle of the lower frequency signal component, the positive input to green comparator 350 is clamped at a threshold of about 1 volt while the positive input to red comparator 252 is saturated at about 7 volts. If during this period an occurrence of the higher frequency 2 KHz marker signal component drives the output signal from voltage doubling and rectifier circuit 324 higher than the 1 volt threshold, the output of green comparator 350 will be driven active low while the output of red comparator 352 is forced inactive high. An inverting low pass filter 354 responds to the active low state of the output of comparator 350 by driving current through green LED 358, causing green LED 358 to become illuminated and indicate a proper phase.

Similarly, during the occurrence of a negative half cycle of the lower frequency signal component, the positive input to red comparator 352 is clamped at a threshold of about 1 volt while the positive input to green comparator 250 is saturated at about 7 volts. If during this period an occurrence of the higher frequency 2 KHz marker signal component drives the output signal from voltage doubling and rectifier circuit 324 higher than the 1 volt threshold, the output of red comparator 352 will be driven active low while the output of red comparator 350 is forced inactive high. An inverting low pass filter 356 responds to the active low state of the output of comparator 352 by driving current through red LED 360, causing red LED 360 to become illuminated and indicate a phase reversal.

It will be appreciated that the time constants of low pass filters 354, 356, which act as a holding circuit for the active signal state, should be sufficient to maintain the LED's 358, 360 illuminated during the approximately 20 msec. intervals between successive repetitions of the marker signals, which repeat about 50 times per second. The time constant should also be short enough that an illuminated LED 358 or 360 is quickly turned off after 20 msec. have passed without the occurrence of a next marker signal.

The higher frequency marker signal component may or may not be reversed in phase each time the lower frequency signal component is reversed in phase. If the phase reversal results from a reversed wiring connection, both signal components will be reversed in phase. However, if the phase reversal results from a poor low frequency response that introduces a phase lag into the lower frequency signal component, the marker signal component might not be reversed in phase. However, because the marker signal component undergoes multiple half cycles at each occurrence, one of the half cycles will be of a positive polarity and permit detection by the detector circuit 312 regardless of whether or not the higher frequency marker signal component is reversed in phase.

The hard limiter 340, inverter 342, resistor network 344 and comparator 350 of detector 312 thus serve as a coincidence circuit determining whether or not the higher frequency marker signal component of the audio frequency test signal is received coincident in time with an occurrence of the lower frequency signal component having the selected positive polarity. The holding circuit 354 and the green LED 358 further provide an indicator circuit that is responsive to the coincidence, the indicator circuit providing a human perceptible indication of whether or not the higher frequency signal component of the audio frequency test signal is received coincident in time with an occurrence of the lower frequency signal component having the selected positive polarity.

The hard limiter 340, resistor network 344 and comparator 352 of detector 312 thus also serve as a second coincidence circuit determining whether or not the higher frequency marker signal component of the audio frequency test signal is received coincident in time with an occurrence of the lower frequency signal component having a negative polarity. The holding circuit 356 and the red LED 360 further provide an indicator circuit that is responsive to the coincidence circuit, the indicator circuit provding a human perceptible indication of whether or not the higher frequency signal component of the audio frequency test signal is received coincident in time with an occurrence of the lower frequency signal component having a negative polarity.

As used in this specification, the word "or" is intended to mean an inclusive or covering either alternative or both alternatives unless the context explicitly indicates otherwise.

In the following claims, it is intended that a claim element be interpreted as a means plus function or step plus function claim element that is to be interpreted to cover the corresponding structure, material or acts described in the specification and equivalents thereof as specified by 35 USC § 112, paragraph 6, when and only when, the claim element recites the express language "means for" or "step" for performing a function.

While there has been shown and described a phase testing system and method for the purpose of enabling a person of ordinary skill in the art to make and use the invention, it will be appreciated that the invention is not limited thereto. For example, specific features or circuits may be disclosed as implemented in a preferred or alternative embodiment of the invention. However, the disclosure of a specific feature or circuit does not mean that the feature or circuit is required for all implementations of the invention or that an alternative feature or circuit (whether or not specifically disclosed) could not be used in place of the disclosed feature or circuit. The embodiment or embodiments described herein are intended to exemplify, but not limit the claimed invention. The subject matter which applicants regards as the invention is defined by the attached claims. Accordingly, any modifications variations or equivalent arrangements within the scope of the attached claims should be considered to be within the scope of the invention.

What is claimed is:

1. An audio signal phase detection system for detecting signal phase reversals within an audio system comprising:

an audio signal source generating an audio signal having a first frequency component having a selected polarity that is marked by a second frequency component that is distinguishable from the first frequency component, the audio signal source being coupled to provide the audio signal to the audio system; and a phase detector coupled to receive a representation of the audio signal from the audio system, the phase detector detecting the marking of the first frequency component by the second frequency component and providing an indication as to whether or not the first frequency component has the selected polarity at the occurrence of the mark.

2. An audio signal phase detection system according to claim 1, wherein the first frequency component is a lower frequency component and the second frequency component is a higher frequency component having a frequency higher than a frequency of the lower frequency component.

3. An audio signal phase detection system according to claim 1, wherein the first frequency component has a frequency in the range of 50 Hertz to 300 Hertz and the second frequency component has a frequency greater than or equal to 2 KHz.

4. An audio signal phase detection system according to claim 3, wherein the second frequency component is repeated not more than 150 times per second.

5. An audio signal phase detection system according to claim 3, wherein the second frequency component is repeated not more than 50 times per second.

6. An audio signal phase detection system according to claim 1, wherein the phase detector includes a light and wherein the phase detector provides an indication as to whether or not the first frequency component has the selected polarity at the occurrence of the mark by illuminating the light when the first frequency component has the selected polarity at the occurrence of the mark and not illuminating the light when the first frequency component does not have the selected polarity at the occurrence of the mark.

7. An audio signal phase detection system according to claim 1, wherein the phase detector includes first and second lights and wherein the phase detector provides an indication as to whether or not the first frequency component has the selected polarity at the occurrence of the mark by illuminating the first light when the first frequency component has the selected polarity at the occurrence of the mark and by illuminating the second light when the first frequency component has a polarity opposite the selected polarity at the occurrence of the mark.

8. An audio signal phase detection system according to claim 7, wherein the first and second lights are light emitting diodes and wherein the selected polarity is a positive polarity.

9. An audio signal phase detection system according to claim 1, wherein the audio signal source includes a recording medium having the audio signal recorded thereon and a player playing the audio signal recorded on the recording medium.

10. An audio signal phase detection system according to claim 1, wherein the audio signal source includes a compact disk recording medium having the audio signal recorded thereon and a compact disk player playing the audio signal recorded on the recording medium.

11. An audio signal phase detection system according to claim 1, wherein the audio signal source includes an active signal generator generating the audio signal while the phase detector determines whether or not the first frequency component has the selected polarity at the occurrence of the mark.

12. An audio signal phase detection system for detecting signal phase reversals within an audio system, the audio signal phase detection system comprising:

an audio signal source generating an audio signal having a first frequency component, a portion of the first frequency component having a selected polarity that is marked by a second frequency component that is distinguishable from the first frequency component, the audio signal source being coupled to provide the audio signal to the audio system; and a phase detector coupled to receive a representation of the audio signal from the audio system, the phase detector detecting the marking of the first frequency component by the second frequency component and providing an indication as to whether or not the first frequency component has a selected polarity at the occurrence of the mark.

13. An audio signal phase detection system for detecting signal phase reversals within an audio system, the audio signal phase detection system comprising:

an audio signal source providing an audio test signal having a plurality of repetitive cycles of an audio signal, the audio test signal including a plurality of cycles of a lower frequency signal component having positive and negative polarity portions and with at least one of the polarity portions of a selected polarity being marked with a higher frequency signal component, the audio test signal being coupled to the audio system; and a phase detector coupled to receive a representation of the audio test signal from the audio system, the phase detector detecting the higher frequency signal component and providing an indication as to whether or not the higher frequency signal component is coincident with the selected polarity of the lower frequency signal component.

14. An audio signal phase detection system for detecting signal phase reversals within an audio system, the audio signal phase detection system comprising:

an audio signal source including a recorded medium having an audio frequency test signal recorded thereon and a medium player reproducing the recorded audio frequency test signal, the audio frequency test signal including a lower frequency signal component having a portion thereof of a selected polarity marked with a higher frequency signal component, the audio frequency test signal being communicated to the audio system; and a phase detector coupled to receive a representation of the audio frequency test signal from the audio system, the phase detector detecting the marking of the selected polarity of the lower frequency signal component by the higher frequency signal component and providing an indication as to whether or not the selected polarity of the lower frequency signal component is marked by the higher frequency signal component.

15. An audio signal phase detection system for detecting signal phase reversals within an audio system comprising:

means for generating an audio signal having a first frequency component having a selected polarity that is marked by a second frequency component that is distinguishable from the first frequency component, the audio signal source being coupled to provide the audio signal to the audio system; and a phase detector coupled to receive a representation of the audio signal from the audio system, the phase detector detecting the second frequency component and providing an indication as to whether or not the first frequency component has the selected polarity at the occurrence of the second frequency component.

16. An audio signal phase detection system for detecting signal phase reversals within an audio system, the audio signal phase detection system comprising:

an audio signal source generating an audio signal having a first, lower frequency signal component, a portion of the first, lower frequency signal component having a selected polarity that is marked by a second, higher frequency signal component having a repetition rate less than 150 times per second, the audio signal source being coupled to provide the audio signal to the audio system; and a phase detector coupled to receive a representation of the audio signal from the audio system, the phase detector detecting the occurrence of the higher frequency signal component mark and providing an indication as to whether or not the first, lower frequency component has the selected polarity at the occurrence of the higher frequency signal component.

17. An audio signal phase detection system for detecting signal phase reversals within an audio system having a recorded medium player, the audio signal phase detection system comprising:

a recorded medium having an audio frequency test signal recorded thereon, the audio frequency test signal including a lower frequency signal component having a portion thereof of a selected polarity marked with a higher frequency signal component; and a phase detector coupled to receive a representation of the audio frequency test signal from the audio system, the received audio frequency test signal being generated by the audio system in response to the audio frequency test signal recorded on the recorded medium, the phase detector detecting the marking of the selected polarity of the lower frequency signal component by the higher frequency signal component and providing an indication as to whether or not the selected polarity of the lower frequency signal component is marked by the higher frequency signal component.

18. An audio signal phase detection system for detecting signal phase reversals within an audio system, the audio signal phase detection system comprising:

means for providing an audio frequency test signal having a higher frequency signal component and a lower frequency signal component, with the higher frequency signal component occurring while the lower frequency signal component has a selected polarity, the audio frequency test signal being coupled to the audio system; and means for phase testing an audio frequency test signal coupled to receive a representation of the audio test frequency signal from the audio system, the means for testing providing an indication as to whether or not the higher frequency signal component occurs during the selected polarity of the lower frequency signal component.

19. A method of detecting signal phase reversals within an audio system, the method comprising the acts of:

providing to the audio system an audio frequency test signal having a higher frequency signal component and a lower frequency signal component, with the higher frequency signal component occurring while the lower frequency signal component has a selected polarity;

receiving a representation of the audio frequency test signal from the audio system;

phase testing the received representation of the audio frequency test signal; and providing an indication as to whether or not the higher frequency signal component occurs during the selected polarity of the lower frequency signal component in the received representation of the audio frequency test signal.

20. A method of detecting signal phase reversals within an audio system using a signal source and a phase detector, the method comprising the acts of:

generating an audio frequency test signal with the signal source, the audio frequency test signal having a higher frequency signal component and a lower frequency signal component, with the higher frequency signal component occurring while the lower frequency signal component has a selected polarity;

communicating the audio frequency test signal to the audio system;

receiving a representation of the audio frequency test signal from the audio system;

phase testing the received representation of the audio frequency test signal; and providing an indication as to whether or not the received representation of the audio frequency test signal has the higher frequency signal component and the lower frequency signal component with the higher frequency signal component occurring during the selected polarity of the lower frequency signal component.

* * * * *